US007772168B2

(12) United States Patent
Stunkel et al.

(10) Patent No.: US 7,772,168 B2
(45) Date of Patent: Aug. 10, 2010

(54) VEGETABLE OIL LUBRICATING COMPOSITION

(75) Inventors: Brian Stunkel, Stamford, CT (US); Gaston A. Aguilar, Milford, CT (US)

(73) Assignee: R.T. Vanderbilt Company, Inc., Norwalk, CT (US)

( * ) Notice: Subject to any disclaimer, the term of this patent is extended or adjusted under 35 U.S.C. 154(b) by 198 days.

(21) Appl. No.: 11/947,154

(22) Filed: Nov. 29, 2007

(65) Prior Publication Data

US 2008/0132434 A1 Jun. 5, 2008

Related U.S. Application Data

(60) Provisional application No. 60/867,847, filed on Nov. 30, 2006.

(51) Int. Cl.
*C10M 133/44* (2006.01)
*C10M 163/00* (2006.01)
*C10M 141/10* (2006.01)

(52) U.S. Cl. ..... 508/279; 508/438; 508/336

(58) Field of Classification Search ..... 508/279, 508/101, 336, 438
See application file for complete search history.

(56) References Cited

U.S. PATENT DOCUMENTS

| | | | | |
|---|---|---|---|---|
| 4,701,273 | A | 10/1987 | Brady et al. | |
| 4,880,551 | A | 11/1989 | Doe | |
| 5,538,654 | A | 7/1996 | Lawate et al. | |
| 6,046,144 | A | 4/2000 | Karol et al. | |
| 6,127,324 | A * | 10/2000 | Tolfa et al. | 508/463 |
| 6,743,759 | B2 * | 6/2004 | Stunkel et al. | 508/281 |
| 2002/0016266 | A1 | 2/2002 | Fletschinger et al. | |
| 2003/0069146 | A1 * | 4/2003 | Garmier | 508/491 |
| 2005/0198894 | A1 | 9/2005 | Migdal et al. | |
| 2006/0073992 | A1 | 4/2006 | Dong et al. | |

* cited by examiner

*Primary Examiner*—Walter D Griffin
*Assistant Examiner*—Frank C Campanell
(74) *Attorney, Agent, or Firm*—Norris, McLaughlin & Marcus

(57) ABSTRACT

A lubricating composition includes, in weight %, at least 90 percent of a vegetable oil, and an additive composition including:

(a) about 1.5 to 2 percent triphenylphosphorothionate (TPPT),
(b) about 0.1 to 3 percent hindered phenolic antioxidant,
(c) about 0.05 to 0.25 percent 1-[di(phenyl)aminomethyl] tolutriazole, and
(d) about 0.05 to 0.5 percent alkyl succinic acid half ester rust inhibitor.

10 Claims, No Drawings

VEGETABLE OIL LUBRICATING COMPOSITION

FIELD OF INVENTION

This application relates to vegetable oil lubricating compositions with improved thermal and oxidative stability, corrosion resistance, and antiwear pressure properties. The application also relates to an additive composition to improve thermal and oxidative stability, corrosion resistance, and antiwear properties of vegetable oil based lubricants.

BACKGROUND OF THE INVENTION

Vegetable oils are biodegradable and unlike petroleum based lubricants, vegetable oils are derived from renewable resources. These characteristics make them excellent base stocks for the formulation of environmentally friendly lubricants. However, one major limitation of vegetable oils is their poor resistance to oxidative and thermal breakdown even in the presence of oxidation and corrosion inhibitors.

In U.S. Pat. No. 4,880,551, there are provided synergistic antioxidant compositions containing (a) 1-[di(4-octylphenyl) aminomethyl]tolutriazole and (b) 2,6-di-t-butyl-4-secbutylphenol, 2,6-di-t-butyl-methylphenol, and butylated phenol mixture. Another aspect of that disclosure concerns a lubricating composition comprising a major portion of mineral oil or synthetic lubricating oil, fluid or grease and 0.1 to 5.0 percent of aforementioned antioxidant composition. However, U.S. Pat. No. 4,880,551 does not consider lubricating compositions based on vegetable oils which are neither mineral nor synthetic in nature.

U.S. Pat. No. 4,880,551 also states that lubricating compositions may further contain extreme pressure agents and antiwear additives among other additives types. Work presented herein confirms that the antioxidant combination in U.S. Pat. No. 4,880,551 is very effective in providing thermal and oxidative stability and corrosion resistance to vegetable oil. However, the addition of phosphorus based or phosphorus/sulfur based ashless antiwear additives were antagonistic on these properties with the surprising exception of triphenylphosphorothionate (TPPT). In addition, antiwear protection provided by TPPT used at the inventive concentration exceeded that of other antiwear additives.

U.S. Pat. No. 5,538,654 discloses lubricating compositions comprised of (A) major amount of a genetically modified vegetable oil and minor amounts of (B) phenolic antioxidant and (C) TPPT in which (A):(B):(C) weight ratio are (94-99.9):(0.05-5):(0.05-1). However, the reference teaches that the upper limit for TPPT is 1%; and therefore does not foresee that the use of TPPT at 1.5 or higher weight percent would improve antiwear protection, or that 1-[di(phenyl)aminomethyl]tolutriazole acts synergistically with TPPT to achieve the desired antiwear protection, as well as acting to prevent detrimental effects on thermal stability and corrosion properties.

Thus, the present invention relates to lubricant compositions comprising a major amount of vegetable oil, and minor amounts of TPPT, phenolic antioxidant, 1-[di(phenyl)aminomethyl]tolutriazole, and ashless rust inhibitor. The invention also relates to an additive composition comprising TPPT, phenolic antioxidants, phenyl amino derivatives of benzo- or tolutriazole, and ashless rust inhibitor, which affords excellent thermal and oxidative stability, corrosion resistance, and antiwear properties when used in combination with vegetable oil based lubricant compositions. In one embodiment of the invention, the additive composition and the lubricating composition containing same are free or substantially free of phosphorus- or sulfur-based ashless antiwear additives, such as ashless dialkyldithiophosphate and amine phosphate antiwear additives, with the exception of TPPT.

SUMMARY OF THE INVENTION

The invention relates to a lubricant composition comprising the following components, all in weight %:

a major amount (i.e. >90%) of a vegetable oil, such as canola oil and other vegetable oils useful as lubricants, such as those disclosed in U.S. Pat. No. 5,538,654, incorporated herein by reference, and an additive composition comprising:

(a) about 1.5 to 2 percent triphenylphosphorothionate (TPPT).

(b) about 0.1 to 3 percent hindered phenolic antioxidant, such as BHT, or other compounds as taught, for example, in U.S. Pat. Nos. 4,701,273 and 4,880,551, incorporated herein by reference.

(c) about 0.05 to 0.25 percent 1-[di(phenyl)aminomethyl] tolutriazole, such as 1-[di(4-octylphenyl)aminomethyl] tolutriazole, or other compounds as taught in, for example, U.S. Pat. Nos. 4,880,551, 6,046,144, and 6,743,759, incorporated herein by reference.

(d) about 0.05 to 0.5 an alkyl succinic acid half ester rust inhibitor.

In a preferred embodiment of the invention, the lubricant composition comprises:

(a) at about 1.5 percent, (b) at about 0.3-1 percent, (c) at about 0.125-0.25 percent, (d) at about 0.1 percent.

The invention also discloses an additive composition for use in vegetable oils. The additive composition is comprised of the following compounds:

(a) triphenylphosphorothionate (TPPT).

(b) percent phenolic antioxidant (c) 1-[di(phenyl)aminomethyl]tolutriazole (d) an alkyl succinic acid half ester rust inhibitor.

at the ratio of (a):(b):(c):(d) as (1.5-2):(0.1-3):(0.05-0.25):(0.05-0.5). A preferred ratio is (1.5-2):(0.3-1):(0.125-0.25):(0.05-0.5), and a more preferred ratio is (1.5):(0.3-1):(0.125-0.25):(0.1).

DETAILED DESCRIPTION OF THE INVENTION

Vegetable oil lubricating compositions with improved thermal and oxidative stability, corrosion resistance, and antiwear pressure properties are described in invention herein. The application also relates to an additive composition to improve thermal and oxidative stability, corrosion resistance, and antiwear properties of vegetable oil based lubricants.

Vegetable Oil

Vegetable oils of this invention are triglyceride mixtures:

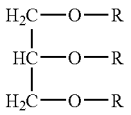

Wherein R are carboxyl groups of fatty acids of which primary examples are listed in Table A. Examples of vegetable oils are corn, cottonseed, safflower, soybean, sunflower and rapeseed (Canola) oils.

TABLE A

| COMMON NAME | SYSTEMATIC NAME | CARBON NUMBER | UNSATURATION |
|---|---|---|---|
| Caprylic acid | Octanoic acid | 8 | 0 |
| Capric acid | Decanoic acid | 10 | 0 |
| Lauric acid | Dodecanoic acid | 12 | 0 |
| Myristic acid | Tetradecanoic acid | 14 | 0 |
| Palmitic acid | Hexadecanoic acid | 16 | 0 |
| Palmitoleic acid | -cis-9-Hexadecenoic acid | 16 | 1 |
| Stearic acid | Octadecanoic acid | 18 | 0 |
| Oleic acid | cis-9-Octadecenoic acid | 18 | 1 |
| Linoleic acid | cis-9-cis-12-Octadecadienoic acid | 18 | 2 |
| Linolenic acid | cis-9-cis-12-cis-15-Octadecatrienoic acid | 18 | 3 |
| Gondoic acid | cis-9-eicosenoic acid | 20 | 1 |
| Erucic acid | cis-13-Docosenoic acid | 22 | 1 |

Vegetable oils can be genetically or chemically modified to reduce polyunsaturation that reduces resistance to oxidative and thermal breakdown. In reducing polyunsaturation, the oleic acid content of vegetable oils is increased to levels above 60 weight percent. For lubricating applications, vegetable oils with high oleic contents (>60 mass percent) are preferred.

Triphenylphosphorothionate (TPPT)

TPPT is phosphorus/sulfur based compound with the following chemical structure:

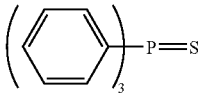

Hindered Phenolic Antioxidants

Phenolic antioxidants of this invention are the alkylated monophenols, methylenebis phenols and esters of beta (3,5 di-tert-4hydroxylphenyl) propionic acid. Alkylated monophenols are of the formula:

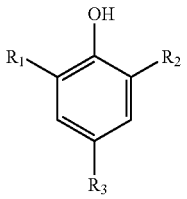

wherein $R_1$ and $R_2$ are independent aliphatic groups that contain 1 to 12 carbons and $R_3$ is hydrogen or aliphatic or alkoxy group containing 1 to 12 carbons. Preferably, $R_1$ and $R_2$ are tert-butyl groups and $R_3$ is hydrogen or methyl groups.

Methylenebis phenols are of the formula:

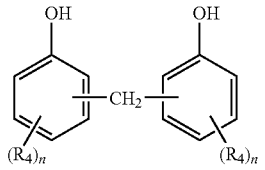

wherein $R_4$ is independent aliphatic group that contain 1 to 18 carbons and n is an integer from 0 to 3 or mixture of alkyl phenol and methylene bridged phenol. Preferred compound is 2,2'-methylenebis-(6-tert-butyl-4-methylphenol).

The formula for esters of beta (3,5 di-tert-4-hydroxylphenyl) propionic acid is the following:

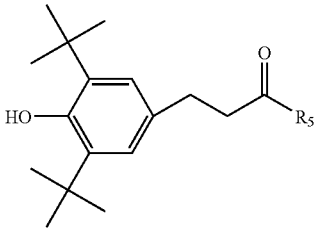

wherein esters are produced from monohydric and polyhydric alcohols. Preferred alcohol is iso-octyl alcohol or $R_5$ is branched $C_8$ alkyl group.

Tolutriazole Derivatives

Tolutriazole derivatives of the invention prepared in known fashion from tolutriazole, formaldehyde and diphenyl amines by means of Mannich reaction and are the following formula:

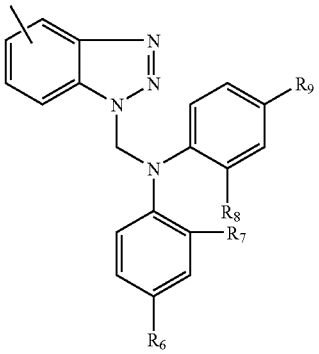

wherein $R_6$, $R_7$, $R_8$ and $R_9$ are independently hydrogen or alkyl and styryl groups that contain 2 to 9 carbons. Preferred compound is 1-[di(4-octylphenyl)aminomethyl]tolutriazole wherein $R_6$, and $R_9$ are octyl groups and $R_7$, and $R_8$ are hydrogen.

Ashless Rust Inhibitor

Ashless rust inhibitors of this invention are alkyl succinic half ester acids:

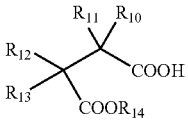

wherein $R_{10}$, $R_{11}$, $R_{12}$, and $R_{13}$ are hydrogen and/or alkyl groups, at least one of $R_{10}$, $R_{11}$, $R_{12}$, and $R_{13}$ is always an alkyl group, and $R_{14}$ is always an aliphatic group. For $R_{10}$, $R_{11}$, $R_{12}$, and $R_{13}$, alkyl groups are polybutyl moiety, fatty acids, isoaliphatic acids (e.g., 8-methyloctadecanoic acid).

For $R_{14}$, alkyl group contains 2 to 6 carbons or is alkoxy group. Commercial examples are VANLUBE® RI-A lubricant additive (alkyl succinic acid half ester derivative), and LUBRIZOL® 859 additive.

Test Methods

Test methods used in this invention to evaluate thermal stability, corrosion resistance, oxidative stability, and wear properties of vegetable oil based lubricating compositions were the following:

1. modified Cincinnati Milicron (CM) Test
2. Pressure Differential Scanning Calorimetry (PDSC), ASTM D 6186
3. 4-Ball Wear, ASTM D 4172

Modified Cincinnati Milacron measures thermal stability and corrosive properties of lubricating fluids. In this procedure, a copper and iron rod are kept in contact with each other under surface of 40 milliliters of test oil in beaker for 7 days at a constant temperature of 135° C. Upon completion, percent change in total acid number (TAN), and viscosity of the test oil is determined and copper and iron rods are rated for corrosion on scale of 1 to 10 with 1 being no corrosion.

PDSC is an instrumental technique that measures the oxidation stability of oils by detecting exothermic release of energy that occurs when oils succumb to autooxidation. For this invention, test oils were held 130° C. under 500 psi of oxygen pressure. The length of time required to reach autooxidation is a measure of oxidation resistance and is known as oxidation induction time.

Four-Ball Wear Test was conducted according to standard procedure described in ASTM D4172. In this test method, one ball is rotated on three evenly spaced static balls while the four balls are completely submerged under the test oil. The tests for this invention were conducted at a rotation speed of 1200 rpm under a load of 40 kg for a hour at 75° C. The scar diameter of three static balls is measured and averaged for the final result. An acceptable result for this test is an average wear scar that is less 0.4 mm in diameter.

EXAMPLE 1

Comparative Data

Lubricating compositions were prepared using high oleic content Canola oil. Canola oil was tested without the addition of TPPT and with the addition of the phenolic antioxidant, tolutriazole derivative and ashless rust inhibitor of the invention. As expected, the addition of the additives led to significant improvement in thermal stability, oxidative stability and corrosion properties with no improvement in wear resistance. The addition of ashless antiwear additives such amine phosphates described in U.S. Pat. Nos. 4,701,273, 5,538,654 and 6,046,144, dialkyldithiophosphate esters described in U.S. Pat. No. 6,046,144 and phosphate esters improved wear resistance but for the most part did not lower wear scars to acceptable result of 0.4 mm or lower. More importantly, the more effective antiwear additives were detrimental to thermal stability and corrosion properties as summarized in Table 1.

EXAMPLE 2

Inventive Data

To Canola oil composition containing phenolic antioxidant, tolutriazole derivative and ashless rust inhibitor was added different concentrations of triphenylphosphorothionate (TPPT) antiwear additive. Unlike other ashless antiwear, TPPT did not negatively affect thermal stability and corrosion properties and more surprisingly, acceptable wear scars were obtained at TPPT concentrations of about 1.5 weight % as summarized in Table 2. Of more surprising significant consequence is experiment 15, which shows that acceptable wear scar, oxidative stability, thermal stability and corrosion properties are not achievable if the tolutriazole derivative is removed from the composition.

TABLE 1

| | 1 | 2 | 3 | 4 | 5 | 6 | 7 | 8 | 9 |
|---|---|---|---|---|---|---|---|---|---|
| High Oleic Content Canola Oil | 100 | 99.125 | 98.625 | 97.625 | 98.625 | 97.625 | 98.625 | 97.625 | 97.625 |
| 2,6-di-t-butyl-p-cresol (BHT) | | 0.65 | 0.65 | 0.65 | 0.65 | 0.65 | 0.65 | 0.65 | 0.65 |
| 1-[di(4-octylphenyl) aminomethyl]-tolutriazole | | 0.125 | 0.125 | 0.125 | 0.125 | 0.125 | 0.125 | 0.125 | 0.125 |
| Vanlube RI-A[1] | | 0.10 | 0.10 | 0.10 | 0.10 | 0.10 | 0.10 | 0.10 | 0.1 |
| $C_{12-14}$-amine isooctyl phosphate | | — | 0.50 | 1.5 | — | — | — | — | — |
| 1,2-Dicarbobutoxyethyl O,O-di-n-2-ethylhexylphosphorodithioate | | — | — | — | 0.5 | 1.5 | — | — | — |
| 1,2-Dicarbobutoxyethyl O,O-di-n-2-propylphosphorodithioate | | — | — | — | — | — | 0.5 | 1.5 | — |
| Isopropyl triphenylphosphate | | | | | | | | | 1.5 |
| 4-Ball Wear, mm, ASTM D 4172, 1200 rpm, 40 kgf, 75° C., 1 h | 0.78 | 0.82 | 0.41 | 0.51 | 0.39 | 0.49 | 0.42 | 0.56 | 0.62 |
| Modified CM | | | | | | | | | |
| %Δ TAN | 383 | 45.5 | 530 | 252 | 375 | 1022 | 586 | 877 | 50.0 |
| %Δ Viscosity | 173 | 18.65 | 43.1 | 27.7 | 20.2 | 26.6 | 20.8 | 33.4 | 20.6 |
| Sludge, mg | 70 | 1.50 | 5.5 | 6.50 | 4.5 | 19.0 | 3.5 | 16.5 | 3.1 |
| Steel Rod Rating | 1 | 1 | 1 | 7 | 2 | 2 | 1.5 | 2 | 1 |
| Copper Rod Rating | 2 | 3 | 2 | 9 | 7 | 6 | 7 | 8 | 2 |

[1]Vanlube ® RI-A is dodecenyl half ester rust inhibitor.

TABLE 2

| | 2 | 10 | 11 | 12 | 13 | 14 | 15 |
|---|---|---|---|---|---|---|---|
| Canola Oil | 99.125 | 98.625 | 98.125 | 97.875 | 97.625 | 97.50 | 97.75 |
| BHT | 0.65 | 0.65 | 0.65 | 0.65 | 0.65 | — | 0.65 |
| Isooctyl-3-(3,5-di-t-butyl-4-hydroxylphenyl) propionate | — | — | — | — | — | 0.65 | — |
| 1-[di(4-octylphenyl) aminomethyl]tolutriazole | 0.125 | 0.125 | 0.125 | 0.125 | 0.125 | 0.25 | — |
| Vanlube RI-A | 0.10 | 0.10 | 0.10 | 0.1 | 0.10 | 0.1 | 0.1 |
| TPPT | — | 0.5 | 1.0 | 1.25 | 1.5 | 1.5 | 1.5 |
| 4-Ball Wear, mm ASTM D 4172, 1200 rpm, 40 kgf, 75 C, 1 h | 0.82 | 0.82 | 0.56 | 0.43 | 0.33 | 0.33 | 0.41 |
| Modified CM | | | | | | | |
| %Δ TAN | 45.5 | | | | 67.9 | 66.7 | 148.0 |
| %Δ Viscosity | 18.65 | | | | 20.1 | 21.9 | 16 |
| Sludge, mg | 1.50 | | | | 4.00 | 3.20 | 3.0 |
| Steel Rod Rating | 1 | | | | 1 | 1 | 3 |
| Copper Rod Rating | 3 | | | | 2 | 2 | 7 |
| PDSC, minutes ASTM D 6186, 130° C. | 100.2 | | | | 109.7 | | 80.5 |

What is claimed is:

1. A lubricating composition comprising, in weight %, greater than 90 percent of a vegetable oil having an oleic acid content of greater than 70%, and an additive composition comprising:

(a) about 1.5 to 2 percent triphenylphosphorothionate (TPPT), (b) about 0.1 to 3 percent hindered phenolic antioxidant, (c) about 0.05 to 0.25 percent 1-[di(4-octylphenyl)aminomethyl]tolutriazole, and (d) about 0.05 to 0.5 percent alkyl succinic acid half ester rust inhibitor wherein the composition is free or substantially free of phosphorus- or sulfur-based ashless antiwear additives, with the exception of TPPT.

2. The composition of claim 1, wherein (b) is chosen from the group consisting of alkylated monophenols, methylenebis phenols and esters of beta (3,5 di-tert-4hydroxylphenyl) propionic acid.

3. The composition of claim 2, wherein (b) is BHT or isooctyl-3-(3,5-di-t-butyl-4-hydroxylphenyl) propionate.

4. The composition of claim 1, wherein:

(b) is present at about 0.3-1 percent, (c) is present at about 0.125-0.25 percent.

5. The composition of claim 4, wherein:

(a) is present at about 1.5 percent, and (d) is present at about 0.1 percent.

6. An additive composition for use in vegetable lubricating oils having an oleic acid content of greater than 70%, consisting of:

(a) triphenylphosphorothionate (TPPT), (b) phenolic antioxidant, (c) 1-[di(4-octylphenyl)aminomethyl]tolutriazole, and (d) an alkyl succinic acid half ester rust inhibitor, at the ratio of (a):(b):(c):(d) as (1.5-2):(0.1-3):(0.05-0.25):(0.05-0.5).

7. The additive composition of claim 6, wherein (b) is chosen from the group consisting of alkylated monophenols, methylenebis phenols and esters of beta (3,5 di-tert-4hydroxylphenyl) propionic acid.

8. The additive composition of claim 7, wherein (b) is BHT or isooctyl -3-(3,5-di-t-butyl-4-hydroxylphenyl) propionate.

9. The additive composition of claim 6, wherein the ratio is (1.5-2):(0.3-1): (0.125-0.25):(0.05-0.5).

10. The additive composition of claim 9, wherein the ratio is (1.5):(0.3-1):(0.125-0.25):(0.1).

* * * * *